United States Patent [19]

Fuchs, Jr.

[11] Patent Number: 4,703,639

[45] Date of Patent: Nov. 3, 1987

[54] APPARATUS AND PROCESS FOR FORCED LUBRICATION PIERCING

[76] Inventor: Francis J. Fuchs, Jr., P.O. Box 10016, Naples, Fla. 33941

[21] Appl. No.: 862,461

[22] Filed: May 12, 1986

[51] Int. Cl.[4] ..... B21C 23/32

[52] U.S. Cl. ..... 72/45; 72/60; 72/254; 72/257; 72/262; 72/264; 72/273.5

[58] Field of Search ..... 72/45, 44, 43, 60, 96, 72/97, 208, 209, 254, 257, 262, 267, 264, 273.5

[56] References Cited

U.S. PATENT DOCUMENTS

| | | | |
|---|---|---|---|
| 551,229 | 12/1895 | Potter | 72/273.5 X |
| 2,167,424 | 7/1939 | Novack | 72/45 |
| 3,172,536 | 3/1965 | Cairns | 72/43 X |
| 4,528,832 | 7/1985 | Fuchs | 72/45 |

FOREIGN PATENT DOCUMENTS

| | | | |
|---|---|---|---|
| 443060 | 4/1927 | Fed. Rep. of Germany | 72/254 |
| 2151171 | 7/1985 | United Kingdom | 72/96 |
| 148774 | 1/1962 | U.S.S.R. | 72/96 |
| 532414 | 10/1976 | U.S.S.R. | 72/44 |
| 535130 | 11/1976 | U.S.S.R. | 267/ |

*Primary Examiner*—E. Michael Combs
*Attorney, Agent, or Firm*—R. Gale Rhodes, Jr.

[57] ABSTRACT

Pressurized fluid, pressurized in excess of the yield strength of a billet or rod, is communicated to the exterior of a piercing punch during piercing of the billet or rod to produce tubing, the pressurized fluid is provided to the exterior of the piercing punch during piercing to provide forced lubrication between the piercing punch and the billet or rod to reduce friction therebetween; such communication of pressurized fluid is also for causing self-centering of the piercing punch with respect to the billet or rod during piercing to produce tubing of uniform wall thickness.

18 Claims, 17 Drawing Figures

FIG. 4
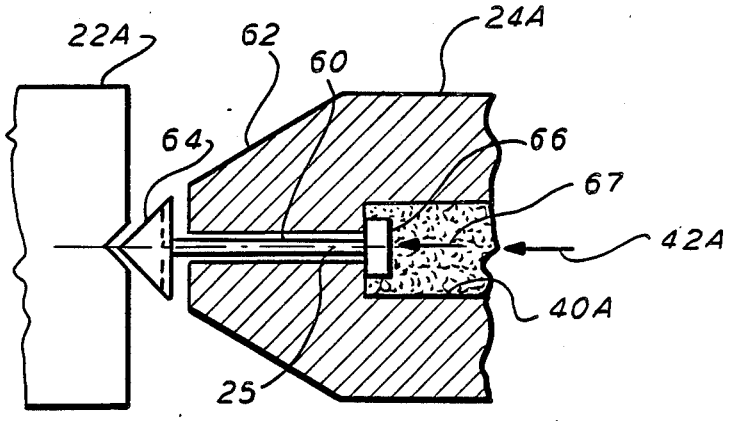
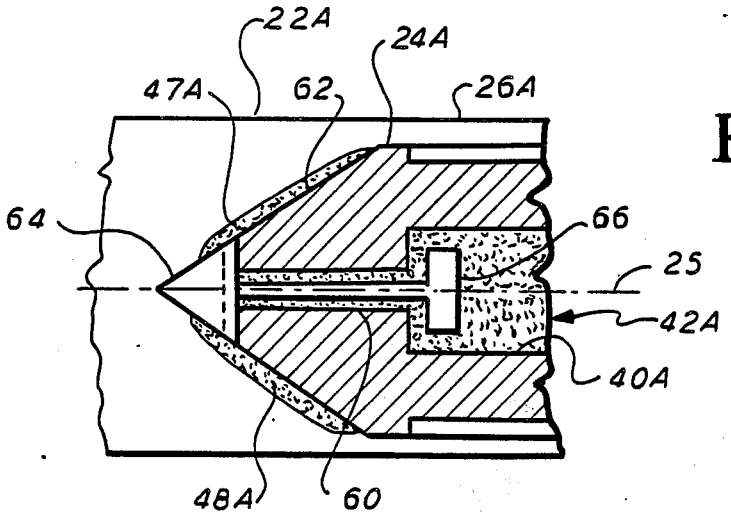
FIG. 5
FIG. 6
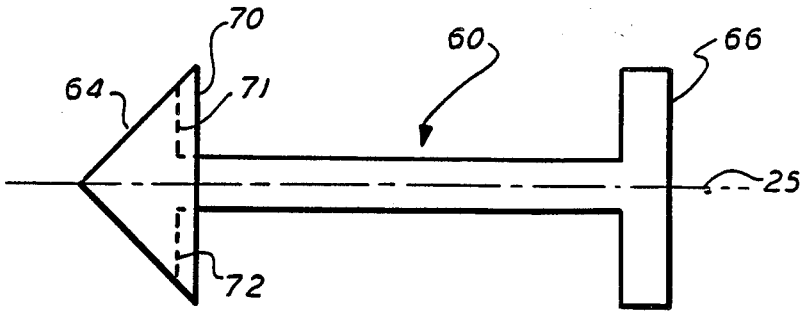

120
122
124
125
126
127
140
142
150
152
162
164
165
166
170
172
173
176
14
15

APPARATUS AND PROCESS FOR FORCED LUBRICATION PIERCING

BACKGROUND OF THE INVENTION

This invention relates generally to new and improved apparatus and process for piercing a workpiece such as a billet or rod; more particularly this invention relates to new and improved apparatus and process for providing forced lubrication between a piercing punch and a workpiece to reduce friction therebetween during piercing, and also for providing such forced lubrication piercing for causing self-centering of the piercing punch with respect to the workpiece during piercing.

Cold and hot piercing are well known to those skilled in the metal working art. However, as is also known to the art both cold and hot piercing prior art techniques have undesirable characteristics. Due to the high friction that develops between the piercing punch and the billet or rod being pierced, cold piercing is generally limited to relatively small diameter and short length piercing. Large diameter and longer length piercing may be accomplished by heating the billet or rod to, or substantially to, its plastic state whereby the friction and force required in hot piercing is reduced. Such hot piercing, as is also known to those skilled in the art, due to the heating requirement is undesirably expensive and complicated. Further, while cold piercing can produce final product, final product typically cannot be produced by hot piercing because upon cooling the pierced metal shrinks, suffers surface degradation, etc., which requires undesirable post hot piercing finishing steps.

Centering of the piercing punch with respect to the rod or billet during piercing is another well known prior art problem associated with piercing.

Accordingly, there exists a need in the piercing art for new and improved piercing process and apparatus for overcoming the above-noted piercing problems attendant to prior art piercing, which permits larger diameter cold piercing of final product to be achieved and which also provides self-centering.

SUMMARY OF THE INVENTION

The object of the present invention is to provide forced lubrication piercing apparatus and process overcoming the abovenoted prior art piercing problems.

The foregoing object is satisfied by the present invention wherein pressurized fluid, pressurized in excess of the yield strength of a billet or rod, is communicated to the exterior of a piercing punch during piercing of a billet or rod to provide forced lubrication between the piercing punch and the billet or rod thereby reducing friction therebetween; such communication of pressurized fluid is also for causing self-centering of the piercing punch with respect to the billet or rod during piercing to produce tubing of uniform wall thickness.

DESCRIPTION OF THE DRAWINGS

FIG. 4 is a detailed view, generally in cross-section, of a piercing punch embodying the present invention;

FIG. 5 is an enlarged diagrammatical view illustrating forced lubrication piercing according to the teachings of the present invention;

FIG. 6 is an enlarged side view of a piercing tip according to the present invention;

DESCRIPTION OF THE PREFERRED EMBODIMENTS

Figure 1:
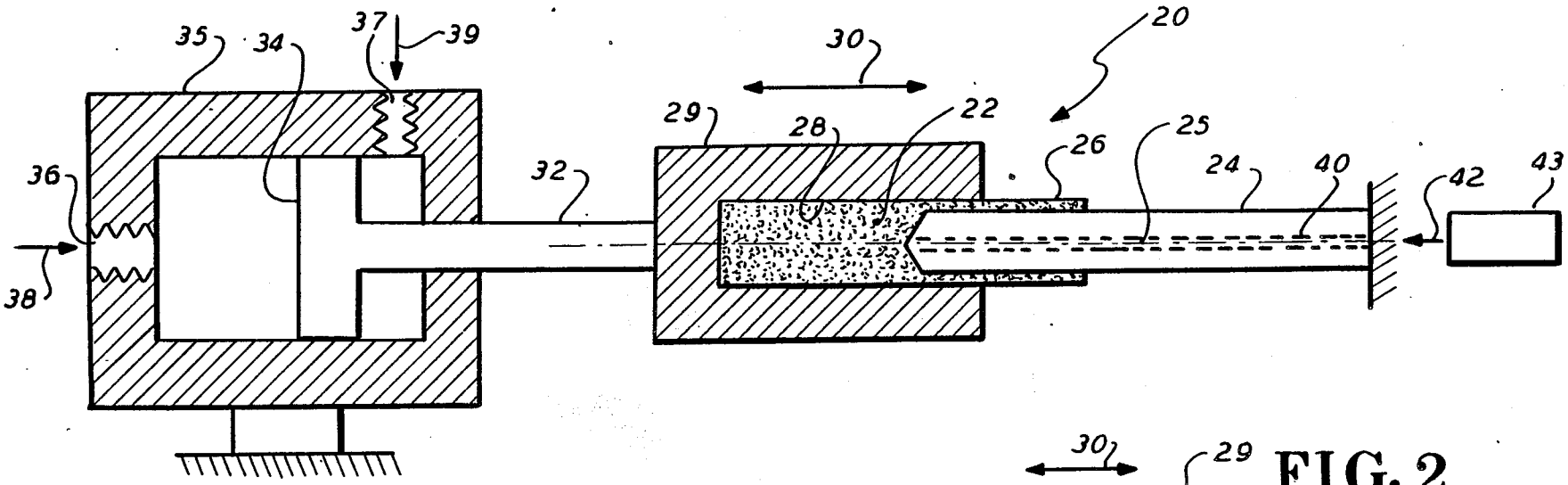
FIG. 1 is a diagrammatical illustration of billet forced lubrication piercing apparatus embodying the present invention and useful for practicing the forced lubrication piercing process of the present invention.

Referring now to FIG. 1, there is shown forced lubrication piercing apparatus and indicated by general numerical designation 20; apparatus 20 embodies the forced lubrication piercing apparatus of the present invention and is also for practicing the forced lubrication piercing process of the present invention. Generally, the apparatus 20 is for the forced lubrication piercing of a billet 22 by a piercing punch 24 to produce tubing 26 of uniform wall thickness. The piercing punch 24 is mounted suitably stationarily and the billet 22 is received within a chamber 28 provided in a reciprocably mounted closed bottom cylinder 29 mounted for reciprocal movement towards and away from the piercing punch 24 as indicated by the double headed arrow 30 by having its closed bottom or rearward portion connected by shaft 32 to a double acting piston 34 mounted reciprocably in a stationarily mounted cylinder 35. Cylinder 35 is provided with respective pressurized fluid inlet ports 36 and 37 for alternately receiving pressurized fluid from suitable sources not shown, but indicated respectively by arrows 38 and 39, for alternately advancing and retracting the cylinder 29 with respct to the stationarily mounted piercing punch 24. The piercing punch 24 is of generally cylindrical shape and extends along a center-line 25 and is provided with a centrally formed passageway 40, shown in dashed outline, also extending along the center-line 25 and for communicating pressurized fluid, pressurized in excess of the yield strength of the billet and indicated by arrow 42, from a suitable source 43 to the exterior of the piercing punch 24 to provide forced lubrication piercing between the piercing punch and the billet 22 during billet piercing to reduce friction therebetween; in particular, and as illustrated more clearly in FIG. 2, the passageway 40 is for communicating pressurized fluid pressurized in excess of the yield strength of the billet 22 to the exterior of the conical forward portion 44 of the piercing punch 24 to provide forced lubrication piercing and reduce friction between the piercing punch conical forward portion and the billet 22 undergoing piercing; the pressurized fluid communicated to the exterior of the piercing punch 24, particularly the conical forward portion 44, is illustrated diagrammatically in FIG. 2 by numerical designations 47 and 48.

Figure 3:
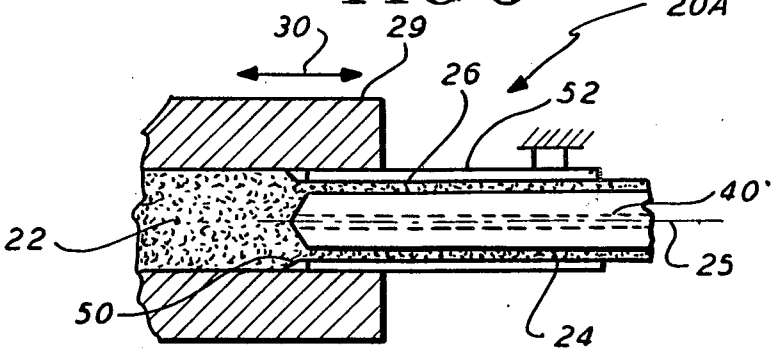
FIG. 3 is a partial view of an alternate embodiment of the apparatus of FIG. 1.

An alternate embodiment of the apparatus of FIG. 1 is illustrated diagrammatically in FIG. 3 and indicated by general numerical designation 20A and this apparatus, in addition to including the structure identified by corresponding numerical designations in FIG. 1, further includes an annular extrusion die 50 mounted concentrically around the piercing punch 24 along the center-line 25 and which annular extrusion die may be, in the mannern known to those skilled in the art, suitably mounted at the end of a tubular mandrel 52 which mandrel may be mounted suitably stationarily as illustrated. The annular extrusion die 50 cooperates with the piercing punch 24 during forced lubrication piercing to produce the tubing 26.

Referring now to FIGS. 4–6 and in particular FIG. 4, there is illustrated a piercing punch 24A for the forced lubrication piercing of a billet 22A and which piercing punch may further includ4e a valve member 60 mounted centrally along center-line 25 in the forward truncated conical portion 62 of the piercing punch 24A and mounted centrally therein between forward and rearward positions, the forward position being illustrated in FIG. 4 and the rearward position being illustrated in FIG. 5. The valve member 60 includes a conical forward portion 64 providing the piercing tip of the piercing punch 24A and a rearward piston portion 66 mounted in the fluid passageway 40A formed in the piercing punch 24A and exposed to pressurized fluid indicated by arrow 42A in FIGS. 4 and 5 for providing forced lubrication piercing upon being communicated to the exterior of the piercing punch 24A. Prior to and upon initial engagement of the piercing punch 24A with the billet 22A, FIG. 4, the pressurized fluid 42A in the passageway 40A will act against the piston portion 66 of the valve member 60 forcing or advancing the valve member 60 to its forward position shown in FIG. 4 to close the passageway 40A to cause pressurized fluid therein to build up pressure for sudden release and forced lubrication piercing upon the valve member 60 being moved into its rearward position illustrated in FIG. 5 upon the forced applied to the piercing tip 64 by the engagement of the piercing tip with the billet 22A exceeding the force, indicaed by arrow 67 in FIG. 4, applied to the piston portion 66 by the pressurized fluid 42A. As illustrated diagrammatically in FIG. 5, upon the valve member 60 being moved to its rearward position, the pressurized fluid 42A is communicated to the exterior of the piercing punch 24A, particularly the conical portion 62, to provide forced lubrication piercing between the piercing punch and the billet 22A to reduce friction therebetween to produce the tubing 26A; the pressurized fluid communicated to the exterior of the conical forward position of the piercing punch 24A is illustrated diagrammatically by numerical designations 47A and 48A in FIG. 5. As may be better understood by reference to FIG. 6, the conical forward portion 64 of the valve member 60 includes an annular rearward base portion 70 which may be provided with a plurality of inwardly extending radially disposed grooves 71 and 72 for communicating the pressurized fluid 42A (FIG. 5) to the exterior of the piercing punch 24A.

Figure 7:
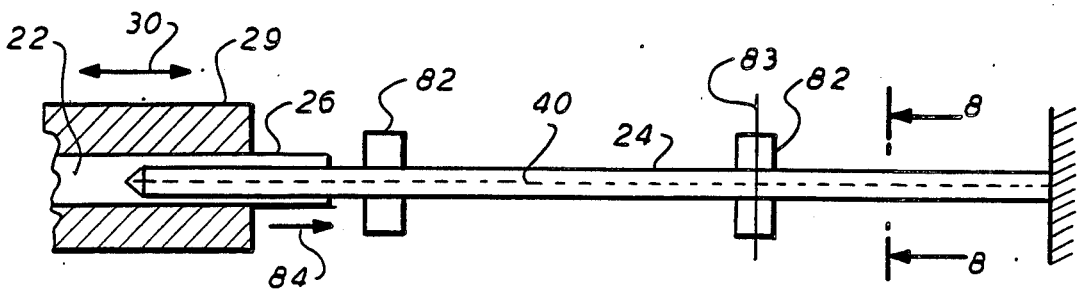
FIG. 7 is a diagrammatical illustration of support apparatus for preventing bending of a piercing punch in the practice of the forced lubrication piercing of the present invention.

Referring now to FIG. 7, it will be understood that the piercing punch 24, structurally speaking, is a "slender column" and hence it has been found that it may be desirable to support the stationarily mounted piercing punch 24 to prevent buckling or bending during forced lubrication piercing. Accordingly, and in accordance with the further teachings of the present invention, the forced lubrication piercing apparatus of the present invention may further include support means indicated diagrammatically in FIG. 7 by numerical designations 81 and 82, for engaging and supporting the piercing punch 24 to prevent buckling during forced lubrication piercing of the billet 22 to produce the tubing 26. It will be understood that the support means, e.g. support means 82, may comprise a plurality of radially disposed movably mounted support members, e.g. radially disposed plurality of support members 82A, 82B and 82C illustrated diagrammatically in FIG. 8, which, as may be noted from FIG. 7, generally occupy a single plane, e.g. plane 83, perpendicular to the piercing punch 24. Referring still to FIG. 7, it will be understood that upon forced lubrication piercing the tubing 26 advances over the mandrel 24 in the direction of the arrow 84 and it will be understood from FIG. 7 that the support members 82-82 occupy the path of the oncoming tubing 26 and thus it will be further understood that in accordance with the further teachings of the present invention the support apparatus 82-82 is movable away from the piercing punch 24 and out of the path of the oncoming tubing 26 to permit the tubing to pass between the support apparatus 82-82 and the piercing punch 24 whereafter, as will be taught in detail below, the support apparatus 82-82 engages the tubing passing between the support apparatus and the piercing punch to provide continued support to the piercing punch through the tubing to prevent piercing punch bending.

Figure 8:
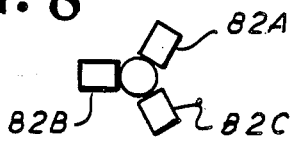
FIG. 8 is an elevational view taken along the line 8—8 in FIG. 7 in the direction of the arrows illustrating diagrammatically support apparatus according to the present invention for providing support to the piercing punch of FIG. 7 during piercing.
Figure 9:
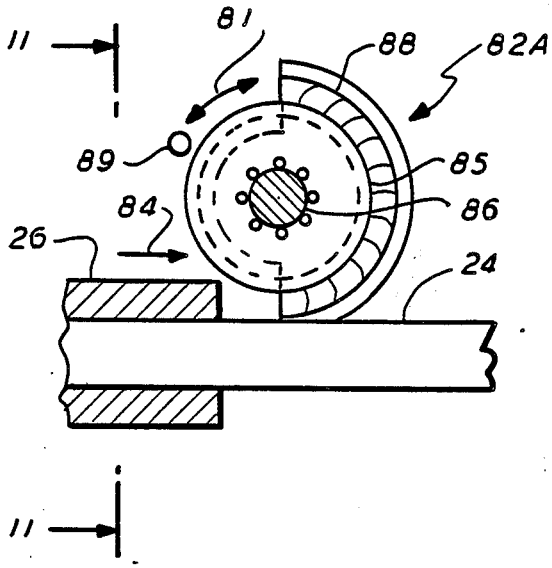
FIGS. 9 and 10 are diagrammatical illustrations, generally in cross-section, of an embodiment of support apparatus in accordance with the teachings of the present invention for supporting the piercing punch and preventing bending thereof during forced lubrication piercing.
Figure 10:
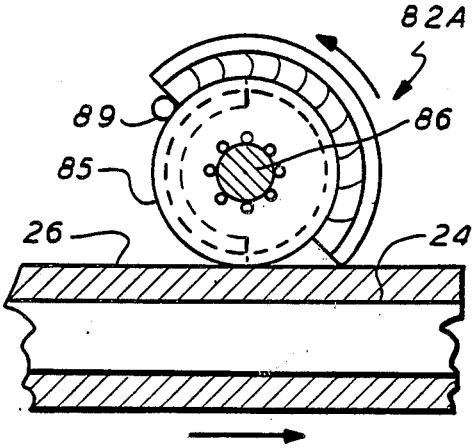
Figure 11:
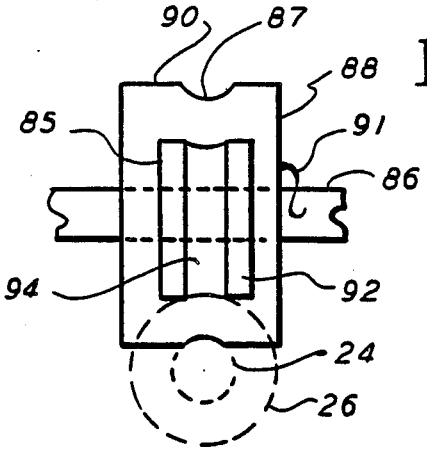
FIG. 11 is an elevational view taken generally along the line 11—11 in FIG. 9 in the direction of the arrows.

Referring now to FIGS. 9–11 there is illustrated in detail an embodiment of support apparatus, such as for example support apparatus 82A, and it will be understood that such apparatus may also comprise support apparatus 82B and 82C of FIG. 8. Support apparatus 82A may include a rotatably mounted annular inner member 85, mounted rotatably by suitable bearings as shown on shaft 86, and a semi-annular outer member 88 mounted rotatably between first and second positions (as indicated by double headed arrow 81) and around the inner member 85, the first position being shown in FIG. 9 and the second position being shown in FIG. 10. The semiannular outer member 88 is spring biased to normally occupy the first position shown in FIG. 9 by a suitable bias or return spring 91 shown in FIG. 11, a stop member 89 may be provided to limit the rotation of the outer member 88 upon engagement by the tubing 26 but such limitation of rotation is sufficient to permit the tubing 26 to pass between the inner member 85 and the piercing punch 24. It will be understood that the semi-annular outer member 88 is provided wth a semi-circular outer surface 90 (FIG. 11) provided with an inwardly extending groove 89 and the portion of the outer surface 90 of the outer member 88 defining the groove 90 is for normally engaging and supporting the piercing punch 24 (note FIG. 11 and the piercing punch 24 shown in dashed outline therein) upon the outer member 88 occupying its normal or first position shown in FIG. 9. The inner annular member 85 (FIG. 11) is provided with an outer circular surface 92 provided with an inwardly extending circular groove 94 and the portion of the outer surface 92 of the inner member 85 defining the circular groove 94 (upon the outer member 88 being engaged by the tubing 26 and rotated into its second position shown in FIG. 10) is for rotatably engaging the tubing 26 (note FIG. 11 and the tubing 26 shown in dashed outline therein) and supporting the piercing punch 24 through the tubing to prevent the piercing punch from bending during piercing. It will be understood that upon the tubing 26 FIG. 9, being advanced over the mandrel 24 the semi-annular outer member 88 will normally occupy its first position shown in FIG. 9 and will therefore occupy the path of the oncoming tubing 26, but due to the rotatable mounting of the outer member 88, upon the outer member being engaged by the advancing tubing 26 the outer member 88 is pivoted out of the path of the tubing and into the second position shown in FIG. 10 allowing the inner member 85 to rotatably engage the oncoming tubing 26 and provide support through the tubing to the piercing punch 24. Upon the tubing being removed from between the inner member 85 and the piercing punch 24, the return spring 91 returns the outer member 88 to its first and normal position shown in FIG. 9.

Figure 12:
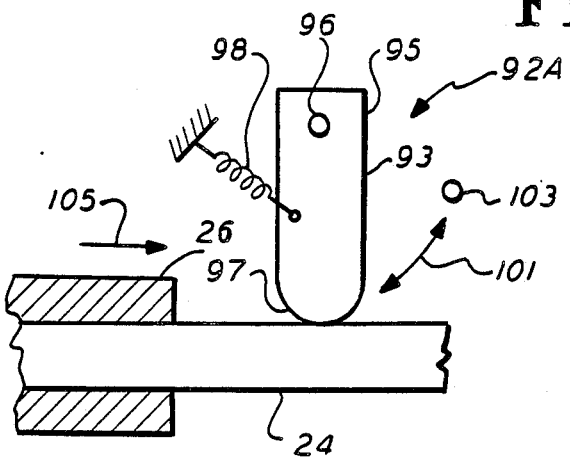
FIGS. 12 and 13 are diagrammatical illustrations, generally in cross-section, of an alternate embodiment of support apparatus according to the teachings of the present invention for supporting the piercing punch during forced lubrication piercing.
Figure 13:
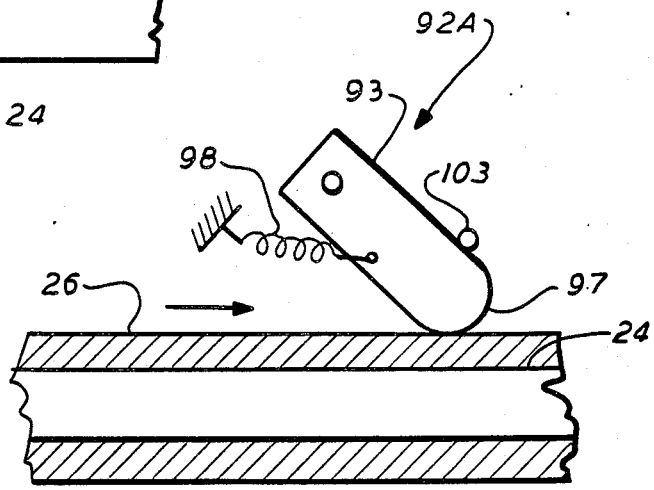

Shown in FIGS. 12 and 13 is an alternate embodiment of support apparatus for supporting the piercing punch 24, such alternate support apparatus being identified by general numerical designation 92A, and it will be understood that a plurality of such support apparatus 92A may be radially disposed in a single plane parallel to the piercing punch 94 in the same manner as the support apparatus 82A, 82B and 82C shown in FIG. 8. Support apparatus 92A may include a generally longitudinally extending support member 93 having rearward and forward ends 95 and 97 respectively; the rearward end 95 is mounted rotatably on a shaft 96 to permit the support member to be rotated between first and second positions as indicated by the double headed arrow 101, the first position being shown in FIG. 12 and the second being shown in FIG. 13, and the forward end 97 of the support member 93 is for engaging the piercing punch 24 to provide the aforementioned support for preventing bending of the piercing punch 24 during forced lubrication piercing. As shown in FIG. 12, upon the support member 93 occupying its normal or first position, the support member occupies the path of the oncoming tubing 26 which, due to forced lubrication piercing, is advancing in the direction of the arrow 105 over the piercing punch 94 and upon the tubing 26 engaging the support member 93 the tubing rotates the support member out of its path and into its second position shown in FIG. 13 where the rotation of the support member 93 is determined by the position of the stop member 103 to be sufficient to allow the tubing 26 to pass between the support member 93 and the piercing punch 24 but having its rotation stopped by the stop member 103 such that the support member 93, as shown in FIG. 13, slidably engages the oncoming tubing 26 and provides support to the piercing punch 24 through the tubing to prevent the piercing punch from bending or bucking during forced lubrication piercing; as may be noted from FIG. 13, upon the support member 93 being rotated into its second position determined by the stop 103 the distance between the forward end 97 of the support member and the piercing punch 24 is substantially equal to the thickness or width of the wall of the tubing 26. Upon the tubing 26 being removed from between the rotated support member 93, FIG. 13, a return spring 98 returns the support member 93 to its normal first position as shown in FIG. 12.

Figures 14, 15, 16:
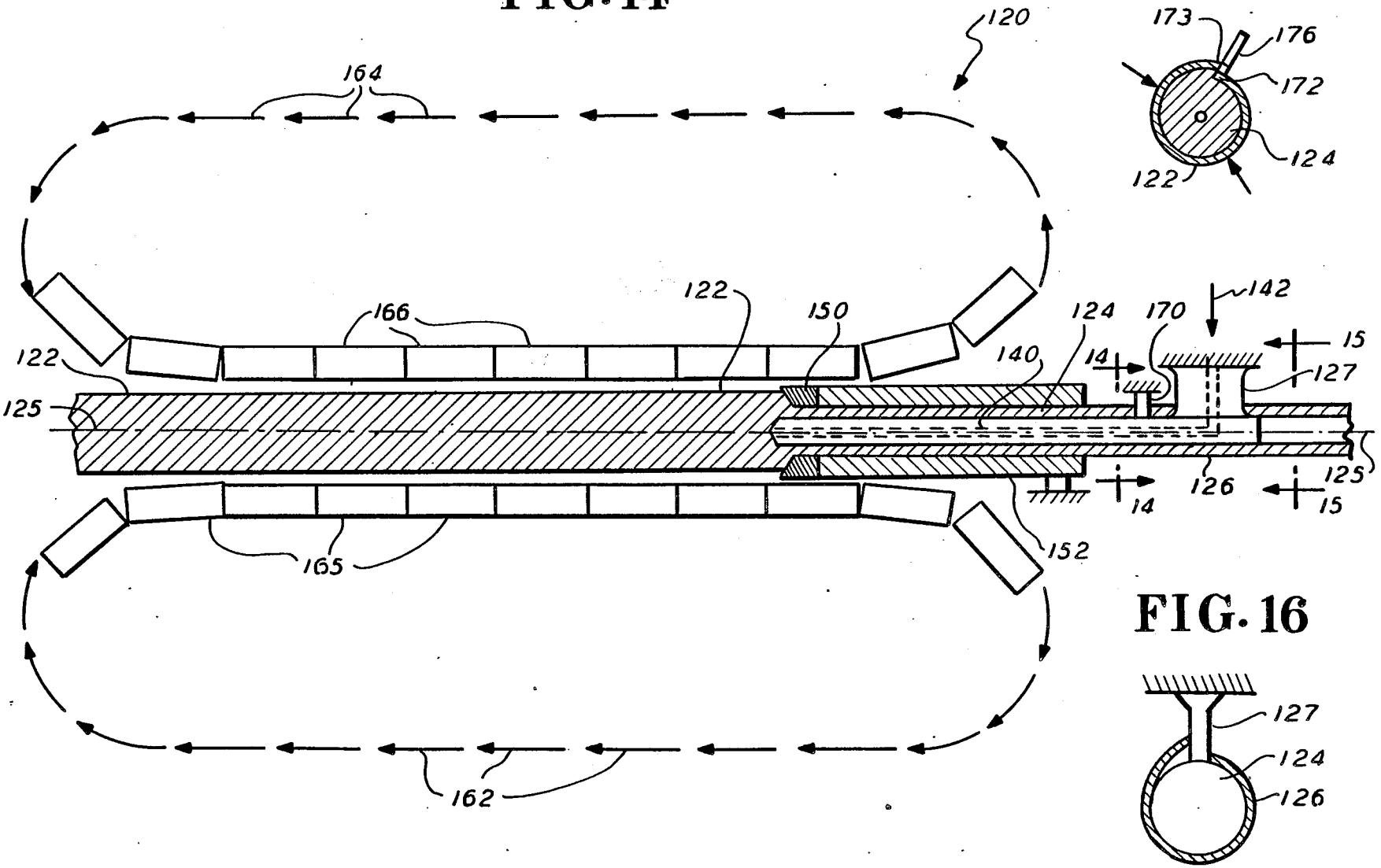
FIG. 14 is a diagrammatical illustration, generally in crosssection, illustrating apparatus embodying the present invention for the continuous forced lubrication piercing of rod in accordance with the teachings of the present invention.
FIGS. 15 and 16 are elevational views taken generally along the respective lines 14—14 and 15—15 in FIG. 14 and in the direction of the arrows.

Continuous forced lubrication piercing, in accordance with the further teachings of the present invention, is illustrated diagrammatically in FIG. 14. Generally, it will be understood that the apparatus indicated by general numerical designation 120 is for continuously advancing rod 126 into engagement with the stationarily mounted piercing punch 124 to continuously produce tubing 126 by the above-described forced lubrication piercing teaching of the present invention. The piercing punch 126 may be mounted stationarily along the center-line 125 by the suitably stationarily mounted web 127 and it will be noted that the passageway 140 for communicating pressurized fluid, pressurized in excess of the yield strength of the rod 122, from a suitable source not shown but indicated diagrammatically by arrow 142, passes through the web 127 thereafter extending centrally of the piercing punch 124 along center-line 125. It will be understood that this apparatus, similar to the apparatus indicated diagrammatically in FIG. 3, may also include an annular extrusion die 150 concentrically aligned with center-line 125 and surrounding the piercing punch 124 with the annular extrusion die 150 mounted suitably at the forward end of a stationarily mounted mandrel 152 as illustrated in FIG. 14. The continuous rod advancing apparatus 120 is illustrated, diagrammatically, by elliptical groups of arrows 162 and 164 and by groups or trains of gripping elements 165 and 166 and which continuous rod advancing apparatus may be, for example, the continuous advancement apparatus disclosed in U.S. Pat. No. Re. 28,795 issued May 4, 1976 in the name of Francis J. Fuchs, Jr.,as inventor; however, it will be expressly understood by those skilled in the art that the present invention is not limited to the use of any such specific continuous rod advancement apparatus and may be used advantageously with other continuous rod advancement apparatus known to the prior art. The trains or groups of gripping elements 165 and 166 move in endless paths, indicated by arrows 162 and 164, in continuous operative engagement with the entire outer surface of the rod 122 to continuously apply motive force to the rod to continuously advance the rod 122 along center-line 125 and into engagement with the piercing punch 124 to continuously provide forced lubrication piercing of the rod and continuously produce tubing 126.

Since the piercing punch 124 is mounted stationarily by the web 127, and since the web 127 is in the path of the continuously produced tubing 126, the apparatus 124 may further include a slitting apparatus located in advance of the web 127 indicated diagrammatically by numerical designation 170 in FIG. 14 for continuously slitting the tubing longitudinally in alignment with the web to permit the slit tubing to continuously pass the web 127. As shown in FIG. 15, it will be understood that the tube slitting apparatus 170 may comprise a first shearing edge 172 provided on a shoulder formed on the piercing punch 124 and a second shearing edge 173 formed on a cutter 176 mounted stationarily opposite the shoulder. After passing the web 27, the slit tubing may be welded by suitabler welding apparatus known to the art to provide continuous tubing or, if desired, the slit tubing may be rolled, by suitable rollers known to the art, into a thin strip.

Figure 17:
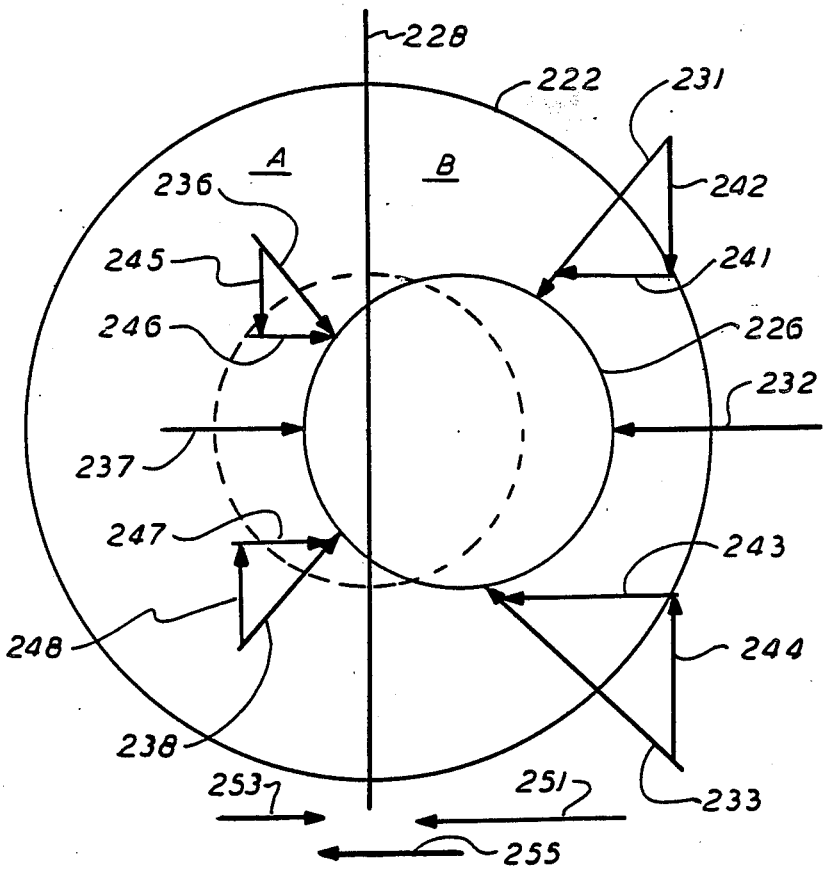
FIG. 17 is a diagrammatical illustration of the self-centering feature of the piercing punch in accordance with the forced lubrication piercing teachings of the present invention.

While not wishing to be bound by theory, to explain the selfcentering feature of the present piercing invention, the following explanation is offered. Referring to FIG. 17, there is illustrated diagrammatically a billet or rod 222 undergoing forced lubrication piercing by a piercing punch 226; the rod or billet is divided by the centerline 228 into leftward and rightward halves indicated respectively by alphbetical designations A and B; the dashed circular outline indicates the position occupied by the piercing punch 226 when properly centered with respect to the billet or rod in the production of tubing of uniform wall thickness. It will now be assumed that the piercing punch 226 is not centered and has moved off-center to the right as shown. Movement of the piercing punch 226 to the right will cause the rightward half B of the billet or rod 222 to undergo a greater area reduction than the leftward half A and this greater area reduction will cause the rightward portion of the piercing punch to experience greater flow stress, indicated by larger arrows 231, 232 and 233 than the left portion of the billet or rod indicated by the smaller arrows 236, 237 and 238; the arrows 231, 233, 236 and 238 can, of course, be resolved into their components as indicated by the component arrows shown. Due to the relative mangitudes of the flow stresses (the rightward off-center position of the piercing punch shown in FIG. 17 being exaggerated for teaching purposes), sum of the arrows 241, 232 and 243 on the right will be larger than the sum of the arrows 256, 237 and 247 on the left, and hence since force equals stress (psi) times area, and since the rightward and leftward portions of the piercing punch acted on by the stresses are substantially equal acting against the rightward and leftward portions of the piercing punch 226, the force acting to the left indicated by arrow 251 will be created by the flow stress acting on the rightward portion of the piercing punch 226 and this force 251 will be larger than the force indicated by arrow 253 acting to the right and created by the flow stress acting on the leftward portion of the punch. Accordingly, the net or sum of the these forces (251 and 253) indicated by arrow 255 will be a force acting on the piercing punch to the left which will move, or tend to move, the piercing punch 226 to the left and back to its center position indicated by the circle shown in dashed outline. Similarly, it will be understood that upon the piercing punch 226 moving in any direction off-center, a net force produced by the respective larger and smaller flow stresses will be produced moving, or tending to move, the piercing punch back to the center thereby causing self-centering of the punch with respect to the billet or rod undergoing piercing. It is believed, and offered by way of explanation as noted above, that it is the presence of the pressurized fluid, pressurized in excess of the yield strength of the billet or rod, between the piercing punch (particularly the forward conical portion) that causes this self-centering feature of the present forced lubrication piercing invention; more particularly it is believed that such pressurized fluid causes the effect of the above-noted flow stresses acting on opposed portions of the piercing punch to predominate over other effects which may be present, particularly friction. Thus, it will be further understood that the provision of pressurized fluid to the exterior of the piercing punch, pressurized in excess of the billet or rod yield strength, is also for causing selfcentering of the piercing punch during piercing.

Figure 2:
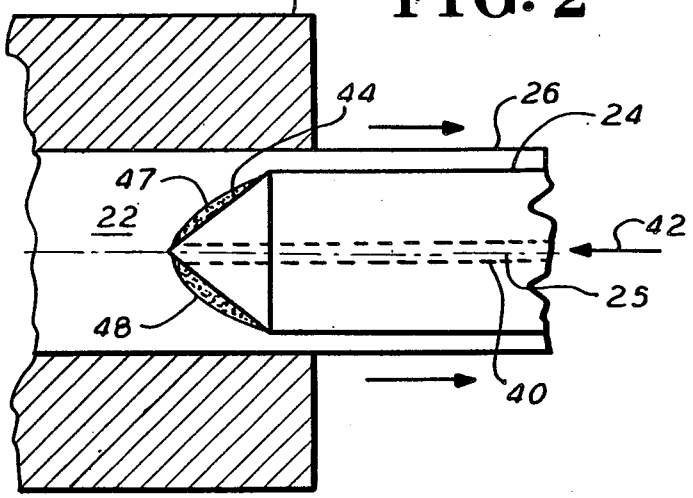
FIG. 2 is an enlarged view of a portion of FIG. 1 and further illustrates diagrammatically forced lubrication piercing of the present invention.

In one embodiment of forced lubrication piercing in accordance with the teachings of the present invention a 0.625 inch diameter aluminum alloy 3003 billet having a yield strength of approximately 8,000 psi was pierced using apparatus of the type illustrated diagrammatically in FIGS. 1 and 2 to produce tubing of uniform wall thickness and the pressurized fluid communicated between the exterior of the piercing punch, particularly the conical forward portion, and the billet, was pressurized to approximately 40,000 psi; the resulting wall thickness in the tubular product varied less than 0.001 inch end-to-end.

It will be further understood by those skilled in the art that many modifications and variations of the present invention may be made without departing from the spirit and scope thereof.

What is claimed is:

1. Forced lubrication piercing apparatus for producing tubing from a billet or rod, comprising:

fluid supply means for supplying pressurized fluid pressurized in excess of the yield strength of said billet or rod;

a piercing punch for engaging and piercing said billet or rod to produce said tubing, said piercing punch provided with a passageway for communicating said pressurized fluid to the exterior of said piercing punch to provide forced lubrication between said piercing punch and said billet or rod during piercing; and advancing means for producing relative motion towards each other between said piercing punch and said rod or billet to cause said piercing punch to engage and pierce said billet or rod.

2. Forced lubrication piercing apparatus according to claim 1 wherein said apparatus has a center-line, wherein said piercing punch is of generally cylindrical shape and extends longitudinally along a center-line, wherein said passageway extends through said piercing punch along said center-line, and wherein said passageway is for both communicating said pressurized fluid to the exterior of said piercing punch to provide said forced lubrication between said piercing punch and said billet or rod during piercing and also for communicating said pressurized fluid to the exterior of said piercing punch during piercing to cause self-centering of said piercing punch along said center-line and with respect to said billet or rod during piercing to produce tubing of uniform wall thickness.

3. Forced lubrication piercing apparatus according to claim 2 wherein said piercing punch includes a rearward cylindrical portion and a forward truncated conical portion and wherein said passageway comprises a first cylindrical passageway extending through said rearward cylindrical portion of said piercing mandrel and a second cylindrical passageway extending through said forward truncated portion of said piercing mandrel and aligned co-axially with and in communication with said first passageway, said second passageway smaller in diameter than said first passageway, and wherein said apparatus further includes a valve member, provided with a conical forward portion provided the piercing tip of said piercing punch, a rearward cylindrical piston portion smaller in diameter than said first passageway and larger in diameter than said second passageway and residing slidably in said first passageway for exposure to said pressurized fluid in said first passageway, and a valve shaft interconnecting said conical forward portion and said rearward piston portion and residing slidably in said second passageway to mount said valve member reciprocably between forward and rearward positions, said piercing tip also for preventing said billet or rod from entering said passageway and said piercing tip and said truncated conical portion of said piercing punch comprising a forward conical portion of said piercing punch; prior to and upon initial engagement of said piercing punch with said billet or rod, said valve member upon said pressurized fluid acting against said rearward piston portion thereof being advanced to said forward position to cause said rearward piston portion to close said second passageway to cause said pressurized fluid in said first passageway to build up pressure, and upon the force applied to the piercing tip by the engagement of said piercing tip with said billet or rod exceeding the force applied to said rearward piston portion by said pressurized fluid said valve member being moved rearwardly to said rearward position to open said second passageway and suddenly communicate said pressurized fluid to the exterior of said conical forward portion of said piercing punch.

4. Forced lubrication piercing apparatus according to claim 3 wherein said conical forward portion of said valve member includes an annular rearward base portion provided with a plurality of inwardly extending radially disposed grooves for communicating said pressurized fluid to said conical forward portion of said exterior of said piercing punch.

5. Forced lubrication piercing apparatus according to claim 1 or 2 wherein said apparatus further includes an annular extrusion die mounted around said piercing punch and spaced therefrom, and said annular extrusion die for cooperating with said piercing punch to produce said tubing.

6. Forced lubrication piercing apparatus according to claim 1 or 2 wherein said piercing punch is mounted stationarily and wherein said advancing means comprise a cylinder mounted reciprocably along said center-line and for movement towards and away from said piercing punch, said cylinder providing a chamber for receiving said billet and said cylinder mounted with said chamber extending along said center-line and in opposition to said piercing punch.

7. Forced lubrication piercing apparatus according to claim 6 wherein said apparatus further includes support means for engaging and supporting said piercing punch to prevent bending thereof during billet piercing, said support means occupying the path of said tubing produced by said piercing, said support means upon engagement by said tubing movable away from said piercing punch and out of the path of said tubing to permit said tubing to pass between said support means and said piercing punch, and said support means thereafter for engaging said tubing passing between said support means and said piercing punch to provide continued support to said piercing punch through said tubing to prevent bending of said piercing punch.

8. Forced lubrication piercing apparatus according to claim 7 wherein said support means comprise a plurality of radially disposed movably mounted support members generally occupying a single plane perpendicular to said piercing punch.

9. Forced lubrication piercing apparatus according to claim 8 wherein each support member comprises a generally longitudinally extending support member having forward and rearward ends with said rearward end disposed away from said piercing punch and mounted pivotally to permit said support member to pivot between first and second positions and with said forward end disposed toward said piercing punch; upon said support member occupying said first position, said forward end engaging and supporting said piercing punch and preventing said piercing punch from bending during piercing, and upon said tubing engaging said support member said support member pivoting into said second position and through an arcuate distance determined by said limit stop such that the distance between the forward end of said support member and said piercing punch is substantially equal to the width of the wall of said tubing and upon said support member occupying said second position said forward end of said support member slidably engaging said tubing and providing support to said piercing punch through said tubing and preventing said piercing punch from bending during piercing; and said support member provided with a return spring for returning said support member to said first position upon said tubing being removed from between said support member and said piercing punch.

10. Forced lubrication punching apparatus according to claim 8 wherein each support member comprises a rotatably mounted annular inner member and a semi-annular outer member mounted rotatably between first and second positions and around said inner member, said outer member having a semi-circular outer surface provided with an inwardly extending groove and the portion of the outer surface of said outer member defining said groove for engaging and supporting said piercing punch upon said outer member occupying said first position, and upon said tubing engaging said outer member said outer member rotating into said second position out of the path of said tubing permitting said tubing to pass between said inner member and said piercing punch, and said inner member having an outer surface provided with an inwardly extending circular groove and the portion of said outer surface of said inner member defining said circular groove for rotatably engaging said tubing and supporting said piercing punch through said tubing to prevent said piercing punch from bending during piercing; said outer member provided with a return spring and upon said tubing being removed from between said inner member and said piercing punch said return spring rotating said outer member back into said first position.

11. Forced lubrication piercing apparatus according to any one of claims 1-2 wherein said piercing punch is mounted stationarily by a web, and wherein said passageway also extends through said web, wherein said advancing means comprise groups of trains of gripping elements for moving in endless paths in continuous operative engagement with the entire outer surface of said rod to continuously apply motive force to said rod to continuously advance said rod along said center-line and into engagement with said piercing punch to continuously pierce said rod to produce said tubing, and wherein said apparatus further includes tubing slitting means mounted in advance of said web for slitting said tubing longitudinally in alignment with said web to permit said slit tubing to continuously pass said web.

12. Forced lubrication piercing apparatus according to claim 11 wherein said slitting means comprise a first shearing edge provided on a shoulder formed on said piercing punch and a second shearing edge formed on a cutter mounted opposite said shoulder.

13. Forced lubrication piercing apparatus according to claim 12 wherein said apparatus further includes an annular extrusion die mounted around said piercing punch and spaced therefrom, and said annular extrusion die for cooperating with said piercing punch to produce said tubing.

14. Forced lubrication piercing process for producing tubing from a billet or rod, comprising the steps of:

supplying pressurized fluid pressurized in excess of the yield strength of said billet or rod;

producing relative motion towards each other between a piercing punch and said rod or billet to cause said piercing punch to engage and pierce said billet or rod and produce said tubing; and communicating said pressurized fluid to the exterior of said piercing punch to provide forced lubrication between said piercing punch and said billet or rod during piercing.

15. Forced lubrication piercing process according to claim 14 wherein said pressurized fluid is communicated to the exterior of said punch through a passageway formed centrally of said punch along the center-line thereof.

16. Forced lubrication piercing process according to claim 14 or 15 wherein said pressurized fluid communication step is also for causing self-centering of said piercing punch with respect to said billet or rod during piercing to produce tubing of uniform wall thickness.

17. Forced lubrication piercing process according to claim 16 including the further steps of closing said passageway prior to and upon initial engagement of said piercing punch with said billet or rod to cause pressurized fluid in said passageway to build up pressure, and subsequent to said initial engagement opening said passageway to communicate said pressurized fluid to the exterior of said piercing punch to provide said forced lubrication and punch self-centering during piercing.

18. Forced lubrication piercing process according to claim 14 wherein said step of producing relative motion is for continuously producing said relative motion to continuously produce said tubing, and wherein said process includes the further step of slitting said tubing in advance of a web supporting said piercing punch to permit said slit tubing to continuously pass said web.

* * * * *